US010522275B2

(12) United States Patent
Wakayama et al.

(10) Patent No.: US 10,522,275 B2
(45) **Date of Patent: *Dec. 31, 2019**

(54) METHOD FOR PRODUCING NANOHETEROSTRUCTURED PERMANENT MAGNET

(71) Applicant: KABUSHIKI KAISHA TOYOTA CHUO KENKYUSHO, Nagakute-Shi, Aichi (JP)

(72) Inventors: Hiroaki Wakayama, Nagoya (JP); Hirotaka Yonekura, Nagoya (JP); Yasuaki Kawai, Nagoya (JP)

(73) Assignee: KABUSHIKI KAISHA TOYOTA CHUO KENKYUSHO, Aichi (JP)

( * ) Notice: Subject to any disclaimer, the term of this patent is extended or adjusted under 35 U.S.C. 154(b) by 337 days.

This patent is subject to a terminal disclaimer.

(21) Appl. No.: 15/600,157

(22) Filed: May 19, 2017

(65) Prior Publication Data

US 2017/0256343 A1 Sep. 7, 2017

Related U.S. Application Data

(62) Division of application No. 14/345,069, filed as application No. PCT/JP2012/073663 on Sep. 14, 2012, now Pat. No. 9,754,709.

(30) Foreign Application Priority Data

Sep. 16, 2011 (JP) ..... 2011-202941

(51) Int. Cl.
*H01F 1/03* (2006.01)
*H01F 1/057* (2006.01)
(Continued)

(52) U.S. Cl.
CPC ..... *H01F 1/0306* (2013.01); *H01F 1/0579* (2013.01); *H01F 41/0266* (2013.01);
(Continued)

(58) Field of Classification Search
CPC ..... H01F 1/0558; H01F 1/0579; H01F 1/083; Y10T 428/24802; Y10T 428/24942
See application file for complete search history.

(56) References Cited

U.S. PATENT DOCUMENTS 6,645,626 B2 11/2003 Garcia et al.
6,972,046 B2 12/2005 Sun et al.
(Continued)

FOREIGN PATENT DOCUMENTS

JP 2001-274009 A 10/2001
JP 2002-339018 A 11/2002
(Continued)

OTHER PUBLICATIONS

Aug. 30, 2017 Office Action filed in U.S. Appl. No. 14/848,650.
(Continued)

*Primary Examiner* — Gerard Higgins
(74) *Attorney, Agent, or Firm* — Oliff PLC

(57) ABSTRACT

A method for producing a nanoheterostructured permanent magnet includes a first step of preparing a raw material solution by dissolving, in a solvent, (1) a block copolymer comprising polymer block components that are immiscible but linked to each other, (2) a first inorganic precursor which is one of a hard magnetic material precursor and a soft magnetic material precursor, and (3) a second inorganic precursor which is the other of the hard magnetic material precursor and the soft magnetic material precursor, and a second step including a phase-separation treatment for forming a nanophase-separated, a conversion treatment for converting the hard magnetic material precursor and the soft
(Continued)

magnetic material precursor to a hard magnetic material and a soft magnetic material, respectively, and a removal treatment for removing the block copolymer from the nano-phase-separated structure.

10 Claims, 2 Drawing Sheets

(51) Int. Cl.
*H01F 41/02* (2006.01)
*H01F 1/06* (2006.01)
*H01F 1/055* (2006.01)
*H01F 1/08* (2006.01)

(52) U.S. Cl.
CPC ..... *H01F 1/0558* (2013.01); *H01F 1/068* (2013.01); *H01F 1/083* (2013.01); *Y10T 428/12* (2015.01); *Y10T 428/24802* (2015.01); *Y10T 428/24942* (2015.01)

(56) References Cited

U.S. PATENT DOCUMENTS 6,979,374 B2 12/2005 Arai et al.
7,158,346 B2 1/2007 Liu et al.
9,914,666 B2 * 3/2018 Wakayama ..... B82Y 25/00
2009/0088325 A1 4/2009 Goyal et al.
2009/0142256 A1 6/2009 Wakayama et al.
2009/0239086 A1 9/2009 Ishizuka et al.
2010/0054981 A1 3/2010 Liu
2013/0037740 A1 * 2/2013 Wakayama ..... B82Y 25/00 252/62.55

FOREIGN PATENT DOCUMENTS

JP 2009-026988 A 2/2009
JP 2009-138014 A 6/2009
JP 2009-255497 A 11/2009
JP 2010-105365 A 5/2010
WO 2011/115165 A1 9/2011

OTHER PUBLICATIONS

Nov. 2, 2015 Office Action filed in Japanese Patent Application No. 2013-533737.
Zang et al.; "Sm(Co,Cu)5/Fe exchange spring multilayer films with high energy product," Applied Physics Letters; 2005, pp. 122509-1-3; vol. 86, American Institute of Physics.
Dec. 18, 2012 International Search Report filed in International Application No. PCT/JP2012/073663.
Mar. 18, 2014 International Preliminary Report on Patentability issued in International Patent Application No. PCT/JP2012/073663.

* cited by examiner 20 nm 20 nm

METHOD FOR PRODUCING NANOHETEROSTRUCTURED PERMANENT MAGNET

RELATED APPLICATIONS

The present application is a divisional application of U.S. application Ser. No. 14/345,069 filed May 2, 2014, which in turn is a U.S. national stage of PCT/JP2012/073663 filed Sep. 14, 2012. Each of these applications is incorporated herein by reference in its entirety.

TECHNICAL FIELD

The present invention relates to a permanent magnet having a nanoheterostructure and a method for producing the same.

BACKGROUND ART

With the size-reduction, higher power output, and densification of power generators, motors, and the like, there arises a demand for a magnet having enhanced magnetic characteristics, especially, having high levels of both saturation magnetization and coercive force. As a magnet having such enhanced magnetic characteristics, for example, Appl. Phys. Lett., 2005, vol. 86, pp. 122509-1 to 3 (NPL 1) proposes a multilayer film in which $Sm(Co,Cu)_5$ layers and Fe layers are alternately stacked on one another at the nano-level by sputtering. According to the description in NPL 1, the multilayer film has a higher maximum energy product than $SmCo_5$ single-phase magnets, and functions as a nanocomposite magnet having excellent magnetic characteristics. However, since the increase in the maximum energy product achieved by the multilayer film of NPL 1 is only about 10% from those of $SmCo_5$ single-phase magnets, there is a demand for a permanent magnet having a higher maximum energy product. In addition, for the multilayer film described in NPL 1, it is necessary to alternately stack the $Sm(Co,Cu)_5$ layers and the Fe layers. Hence, the production process of the multilayer film is complicated. In addition, when layers are stacked by the sputtering method, the molecular beam epitaxy method (MBE method), the chemical vapor deposition method (CVD method), or the like, the kind of the metal constituting each layer is limited to those from which a film can be formed by these methods, and it is difficult to precisely control the composition.

CITATION LIST

Non Patent Literature (NPL 1) J. Zhang et al., Appl. Phys. Lett., 2005, vol. 86, pp. 122509-1 to 3

SUMMARY

Technical Problem

The present invention has been made in view of the above-described problems of the conventional technologies, and an object of the present invention is to provide a permanent magnet having a nanostructure and a high maximum energy product, i.e., a permanent magnet having high levels of both saturation magnetization and coercive force, and a method for producing the permanent magnet.

Solution to Problem

The present inventors have earnestly studied in order to achieve the above object. As a result, the present inventors have found that when a first polymer block component constituting a block copolymer is used in combination with one inorganic precursor of a hard magnetic material precursor and a soft magnetic material precursor, and a second polymer block component is used in combination with the other inorganic precursor of the hard magnetic material precursor and the soft magnetic material precursor, a nanophase-separated structure is formed by utilizing self-assembly of the block copolymer. In addition, when the inorganic precursors are converted to a hard magnetic material and a soft magnetic material, respectively, and the block copolymer is removed, a permanent magnet having a nanoheterostructure comprising the hard magnetic material and the soft magnetic material of which one inorganic component is a matrix, and of which the other inorganic component is arranged with a three-dimensional nanoscale periodicity in the matrix. Moreover, the present inventors have found that this nanoheterostructured permanent magnet has high levels of both saturation magnetization and coercive force. These findings have led to the completion of the present invention.

Specifically, a method for producing a nanoheterostructured permanent magnet of the present invention comprises:

a first step of preparing a raw material solution by dissolving, in a solvent,

- a block copolymer comprising at least a first polymer block component and a second polymer block component which are immiscible but linked to each other,
- a first inorganic precursor which is one of a hard magnetic material precursor and a soft magnetic material precursor, and
- a second inorganic precursor which is the other of the hard magnetic material precursor and the soft magnetic material precursor; and a second step including

- a phase-separation treatment for forming a nanophase-separated structure in which at least a first polymer phase comprising the first polymer block component with the first inorganic precursor introduced thereinto and a second polymer phase comprising the second polymer block component with the second inorganic precursor introduced thereinto are regularly arranged by self-assembly,
- a conversion treatment for converting the hard magnetic material precursor and the soft magnetic material precursor to a hard magnetic material and a soft magnetic material, respectively, and
- a removal treatment for removing the block copolymer from the nanophase-separated structure, to thereby obtain a nanoheterostructured permanent magnet comprising the hard magnetic material and the soft magnetic material.

A solubility parameter difference between the first inorganic precursor and the first polymer block component used in the present invention is preferably 2 $(cal/cm^3)^{1/2}$ or less, and a solubility parameter difference between the second inorganic precursor and the second polymer block component used in the present invention is preferably 2 $(cal/cm^3)^{1/2}$ or less.

Moreover, a solubility parameter difference between the first polymer block component and the first inorganic precursor used in the present invention is preferably smaller than a solubility parameter difference between the first polymer block component and the second inorganic precursor used in the present invention. Furthermore, a solubility parameter difference between the second polymer block component and the second inorganic precursor is preferably smaller than a solubility parameter difference between the second polymer block component and the first inorganic precursor.

When the block copolymer used in the present invention comprises at least one first polymer block component and at least one second polymer block component which are linked to each other, the first polymer block component being selected from the group consisting of a polystyrene component, a polyisoprene component, and a polybutadiene component, the second polymer block component being selected from the group consisting of a poly(methyl methacrylate) component, a poly(ethylene oxide) component, a polyvinylpyridine component, and a poly(acrylic acid) component, the first inorganic precursor is preferably at least one of organometallic compounds and organometalloidal compounds having at least one structure selected from the group consisting of a phenyl group, long hydrocarbon chains having 5 or more carbon atoms, a cyclooctatetraene ring, a cyclopentadienyl ring, and an amino group, and the second inorganic precursor is preferably at least one selected from the group consisting of salts of metals or metalloids, metal- or metalloid-containing alkoxides having 1 to 4 carbon atoms, and metal or metalloid acetylacetonate complexes.

Meanwhile, a nanoheterostructured permanent magnet of the present invention which is made obtainable by the production method of the present invention comprises a hard magnetic material and a soft magnetic material of which one inorganic component is a matrix, and of which the other inorganic component is three-dimensionally and periodically arranged in the matrix, in a shape selected from the group consisting of a spherical shape, a columnar shape, and a gyroid shape, the nanoheterostructured permanent magnet having a three-dimensional periodic structure whose average value of one unit length of a repeated structure is 1 nm to 100 nm.

In the nanoheterostructured permanent magnet of the present invention, a volume of part of a region comprising the soft magnetic material preferably accounts for 50% by volume or more of the total volume of the soft magnetic material, the part satisfying a condition that a distance from an interface with the hard magnetic material is 10 nm or less.

In addition, in the nanoheterostructured permanent magnet of the present invention, the hard magnetic material is preferably at least one magnet selected from the group consisting of ferrite-based magnets, rare earth-based magnets, and noble metal-based magnets, and the soft magnetic material is preferably at least one selected from the group consisting of iron, cobalt, iron-cobalt alloys, iron-nickel alloys, iron-noble metal alloys, silicon steel, Sendust, and soft ferrite.

Note that although it is not known exactly why the nanoheterostructured permanent magnet of the present invention can be obtained by the method of the present invention, the present inventors speculate as follows. Specifically, first, a block copolymer comprising two kinds of polymer block components A and B which are immiscible but linked to each other forms a nanophase-separated structure in which a phase A and a phase B are spatially separate from each other (self-assembly) by being subjected to a heat treatment at or above its glass transition temperature. Here, the phase-separated structure generally varies depending on the molecular weight ratio of the polymer block components. Specifically, as the molecular weight ratio of A:B deviates from 1:1, the structure changes from a gyroid structure in which two continuous phases are mingled with each other, to a columnar structure, and further to a spherical structure. Note that FIG. 1 is a schematic diagram illustrating nanophase-separated structures generated from block copolymers. Shown from the left are a gyroid structure (a), a columnar structure (b), and a spherical structure (c). Generally, the proportion of A in the structure on the right is higher.

In the method for producing a nanoheterostructured permanent magnet of the present invention, first, multiple inorganic precursors are arranged with a three-dimensional nanoscale periodicity by utilizing the self-assembly of the block copolymer. Specifically, a block copolymer comprising multiple polymer block components which are immiscible with each other undergoes phase separation on a nanoscale by self-assembly as described above. Here, in the present invention, it is preferable to use a first polymer block component constituting the block copolymer in combination with a first inorganic precursor which is one of a hard magnetic material precursor and a soft magnetic material precursor, and to use a second polymer block component in combination with a second inorganic precursor which is the other of the hard magnetic material precursor and the soft magnetic material precursor. Moreover, it is preferable to use a first inorganic precursor having a solubility parameter different from that of the first polymer block component by 2 $(cal/cm^3)^{1/2}$ or less in combination with a second inorganic precursor having a solubility parameter different from that of the second polymer block component by 2 $(cal/cm^3)^{1/2}$ or less. Thereby, a nanophase-separated structure is formed with achievement of self-assembly of the block copolymer, while the first inorganic precursor and the second inorganic precursor are sufficiently introduced into the first polymer block component and the second polymer block component, respectively. As the nanophase-separated structure is made to have a predetermined structure, the inorganic precursors are arranged with a three-dimensional nanoscale periodicity.

Further, in the present invention, the hard magnetic material precursor and the soft magnetic material precursor are converted to a hard magnetic material and a soft magnetic material, respectively, and the block copolymer is removed. Thereby, a permanent magnet having a nanoheterostructure is obtained which comprises a hard magnetic material and a soft magnetic material of which one inorganic component is a matrix, and of which the other inorganic component is arranged in a predetermined shape with a three-dimensional specific nanoscale periodicity in the matrix, depending on the shape of the nanophase-separated structure. Note that, in the present invention, the first inorganic precursor and the second inorganic precursor are used in combination with the first polymer block component and the second polymer block component, respectively. Further, the solubility parameter difference of each combination is preferably 2 $(cal/cm^3)^{1/2}$ or less. Thereby, sufficiently large amounts of the inorganic precursors are introduced into the polymer block components, respectively. The present inventors speculate that, for this reason, the three-dimensional nanoscale periodic structure is sufficiently kept, even when the hard magnetic material precursor and the soft magnetic material precursor are converted to the hard magnetic material and the soft magnetic material, respectively, and the block copolymer is removed.

Note that, in the present invention, the "solubility parameter" is a so-called "SP value" defined by the regular solution theory introduced by Hildebrand, and is a value obtained based on the following equation:

$$\text{Solubility parameter } \delta\ [(cal/cm^3)^{1/2}]=(\Delta E/V)^{1/2}$$

(where ΔE represents molar energy of vaporization [cal], and V represents a molar volume [$cm^3$]).

Moreover, in the present invention, the "average value of one unit length of a repeated structure" is an average value of distances between the centers of adjacent pieces of one inorganic component arranged in a matrix comprising the other inorganic component, and corresponds to a distance (d) of a so-called periodic structure. The distance (d) of the periodic structure can be obtained by small-angle X-ray diffraction as described below. Moreover, the structure such as a spherical structure, a columnar structure, or a gyroid structure according to the present invention can also be specified by a characteristic diffraction pattern measured by small-angle X-ray diffraction as described below.

Specifically, by small-angle X-ray diffraction, Bragg reflection is observed from characteristic lattice planes of a pseudo-crystalline lattice in which a structure having a shape such as a spherical shape, a columnar shape, or a gyroid shape is periodically arranged in a matrix. Here, if a periodic structure is formed, diffraction peaks are observed, and a structure such as a spherical structure, a columnar structure, or a gyroid structure can be identified from the ratio of the magnitudes ($q=2\pi/d$) of these diffraction spectra. Moreover, from the peak position of such a diffraction peak, the distance (d) of the periodic structure can be calculated according to Bragg's equation ($n\lambda=2d \sin \theta$; λ represents the wavelength of an X-ray, and θ represents a diffraction angle). Table 1 below shows the relation between each structure and the ratio of magnitudes (q) of diffraction spectra at the peak positions. Note that all the peaks shown in Table 1 do not necessary have to be observed, as long as the structure can be identified from the observed peaks.

TABLE 1

| Structure | Ratio of q at peak positions |
|---|---|
| sphere | 1:√2:√3:√4: . . . |
| column | 1:√3:√4:√7: . . . |
| gyroid | 1:√4/3:√7/3:√8/3: . . . |

Further, it is also possible to identify the structure such as a spherical structure, a columnar structure, or a gyroid structure according to the present invention by using a transmission electron microscope (TEM) with which the shape and the periodicity can be determined and evaluated. Further, it is possible to determine the three-dimensionality more specifically by observations made in different directions, or by using three-dimensional tomography.

Advantageous Effects

The present invention makes it possible to obtain a permanent magnet which has a nanoheterostructure comprising a hard magnetic material and a soft magnetic material of which one inorganic component is a matrix, and of which the other inorganic component is arranged with a three-dimensional nanoscale periodicity in the matrix, and which has high levels of both saturation magnetization and coercive force.

DESCRIPTION OF EMBODIMENTS

Figure 1:
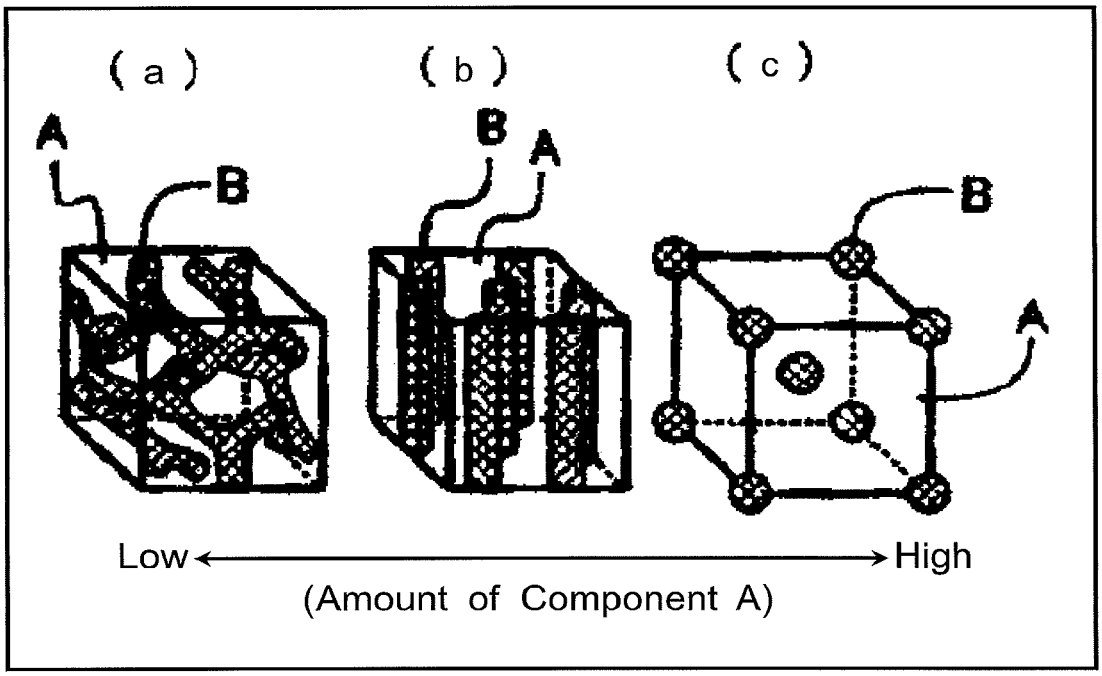
FIG. 1 is a schematic diagram illustrating nanophase-separated structures generated from A-B type block copolymers.

Hereinafter, the present invention will be described in detail on the basis of preferred embodiments thereof.

First, a nanoheterostructured permanent magnet of the present invention is described. The nanoheterostructured permanent magnet of the present invention comprises a hard magnetic material and a soft magnetic material of which one inorganic component is a matrix, and of which the other inorganic component is three-dimensionally and periodically arranged in the matrix, in a shape selected from the group consisting of a spherical shape, a columnar shape, and a gyroid shape, the nanoheterostructured permanent magnet having a three-dimensional periodic structure whose average value of one unit length of a repeated structure is 1 nm to 100 nm (more preferably 1 nm to 50 nm, and particularly preferably 1 to 30 nm).

The nanoheterostructured permanent magnet of the present invention has a structure that has not been formed by conventional production methods. It is possible to obtain those having a nanoheterostructure in which the arrangement, composition, structure scale, and the like of various combinations of the hard magnetic material and the soft magnetic material are controlled in various ways. Therefore, the nanoheterostructured permanent magnet of the present invention exhibits a flux pinning effect because of the magnetic exchange interaction between the hard magnetic material and the soft magnetic material, and achieves remarkable improvements in interface increasing effect, nanosize effect, durability, and the like upon conventional nanostructured permanent magnets. Consequently, the nanoheterostructured permanent magnet of the present invention has both the high coercive force of the hard magnetic material and the high saturation magnetization of the soft magnetic material.

In addition, in the nanoheterostructured permanent magnet of the present invention, a volume of part of a region comprising the soft magnetic material preferably accounts for 50% by volume or more of the total volume of the soft magnetic material, the part satisfying a condition that a distance from an interface with the hard magnetic material is 10 nm or less. If the volume of the part of the soft magnetic material satisfying the above-described condition is less than the lower limit, part of the soft magnetic material where the magnetic exchange interaction does not take place increases, so that the coercive force tends to decrease.

As the hard magnetic material constituting the nanoheterostructured permanent magnet of the present invention, any known hard magnetic material can be used, as long as it has a high coercive force. Preferred examples thereof include ferrite-based magnets such as $BaFe_{12}O_{19}$, $SrFe_{12}O_{19}$, $BaFe_{18}O_{27}$, and $SrFe_{18}O_{27}$, rare earth-based magnets such as $SmCo_5$, $Pr_2Fe_{14}B$, $Nd_2Fe_{14}B$, $Dy_2Fe_{14}B$, $Sm(Fe_{11}Ti)$, $Y(Fe_{11}Ti)$, $Sm_2Co_{17}$, $Er_2Co_{17}$, $Y_2Co_{17}$, and $Sm_2Fe_{17}N_3$, and noble metal-based magnets such as FePt and FePd. One of these hard magnetic materials may be used alone, or two or more thereof may be used in combination.

Meanwhile, as the soft magnetic material constituting the nanoheterostructured permanent magnet of the present invention, any known soft magnetic material can be used as long as it has a low coercive force and a high magnetic permeability. Preferred are iron, cobalt, iron-cobalt alloys (such as Permendur), iron-nickel alloys (such as permalloy), iron-noble metal alloys (such as $Fe_3Pt$), silicon steel, Sendust, and soft ferrite. One of these soft magnetic materials may be used alone, or two or more thereof may be used in combination.

Next, a method for producing a nanoheterostructured permanent magnet of the present invention is described. The method for producing a nanoheterostructured permanent magnet of the present invention comprises:

a first step of preparing a raw material solution by dissolving, in a solvent, a block copolymer comprising at least a first polymer block component and a second polymer block component which are immiscible but linked to each other, a first inorganic precursor which is one of a hard magnetic material precursor and a soft magnetic material precursor, and a second inorganic precursor which is the other of the hard magnetic material precursor and the soft magnetic material precursor; and a second step including a phase-separation treatment for forming a nanophase-separated structure in which at least a first polymer phase comprising the first polymer block component with the first inorganic precursor introduced thereinto and a second polymer phase comprising the second polymer block component with the second inorganic precursor introduced thereinto are regularly arranged by self-assembly, a conversion treatment for converting the hard magnetic material precursor and the soft magnetic material precursor to a hard magnetic material and a soft magnetic material, respectively, and a removal treatment for removing the block copolymer from the nanophase-separated structure, to thereby obtain a nanoheterostructured permanent magnet comprising the hard magnetic material and the soft magnetic material. Hereinafter, each of the steps is described.

First Step: Raw Material Solution Preparation Step

This step is a step of preparing a raw material solution by dissolving, in a solvent, a block copolymer described below and inorganic precursors described below.

The block copolymer used in the present invention comprises at least a first polymer block component and a second polymer block component which are linked to each other. Specific examples of the block copolymer include A-B type and A-B-A type block copolymers having a structure such as -(aa . . . aa)-(bb . . . bb)- in which a polymer block component A (first polymer block component) having a repeating unit a and a polymer block component B (second polymer block component) having a repeating unit b are linked end to end. Moreover, the block copolymer may be of a star type in which at least one polymer block component extends radially from a center, or of a type in which another polymer component is branched from the main chain of the block copolymer.

The kinds of the polymer block components constituting the block copolymer used in the present invention are not particularly limited, as long as the polymer block components are immiscible with each other. Thus, the block copolymer used in the present invention preferably comprises polymer block components having different polarities. Specific examples of such a block copolymer include polystyrene-poly(methyl methacrylate) (PS-b-PMMA), polystyrene-poly(ethylene oxide) (PS-b-PEO), polystyrene-polyvinylpyridine (PS-b-PVP), polystyrene-poly (ferrocenyldimethylsilane) (PS-b-PFS), polyisoprene-poly (ethylene oxide) (PI-b-PEO), polybutadiene-poly(ethylene oxide) (PB-b-PEO), polyethylethylene-poly(ethylene oxide) (PEE-b-PEO), polybutadiene-polyvinylpyridine (PB-b-PVP), polyisoprene-poly(methyl methacrylate) (PI-b-PMMA), polystyrene-poly(acrylic acid) (PS-b-PAA), polybutadiene-poly(methyl methacrylate) (PB-b-PMMA), and the like. In particular, PS-b-PVP, PS-b-PEO, PS-b-PAA, and the like are preferable from the viewpoint that precursors are more likely to be introduced into the respective polymer block components. This is because if the polymer block components greatly differ from each other in polarity, precursors which greatly differ from each other in polarity can also be used for the introduction.

The molecular weights of the block copolymer and the polymer block components constituting the block copolymer can be selected as appropriate in accordance with the structure scale (the size and distance of spheres, columns, layers, or the like) and the arrangement of a nanoheterostructured permanent magnet to be produced. For example, by adjusting the molecular weight of the polymer block component constituting the polymer phase into which the soft magnetic material precursor of the nanophase-separated structure is introduced among the polymer block components constituting the block copolymer, the volume of the predetermined part of the soft magnetic material can be controlled to a desired ratio. By increasing the molecular weight of the polymer block component constituting the polymer phase into which the soft magnetic material precursor is introduced, the ratio of the volume of the predetermined part of the soft magnetic material can be increased. In addition, by adjusting the molecular weight ratio between the polymer block component constituting the polymer phase into which the soft magnetic material precursor is introduced and the polymer block component constituting the polymer phase into which the hard magnetic material precursor is introduced, the volume of the predetermined part of the soft magnetic material can be controlled to a desired ratio. By relatively increasing the molecular weight of the polymer block component constituting the polymer phase into which the soft magnetic material precursor is introduced, the ratio of the volume of the predetermined part of the soft magnetic material can be increased. Note that the number average molecular weight of each of the polymer block components is preferably 100 to 10,000,000 (more preferably 1,000 to 1,000,000). It is also preferable to use a block copolymer which is easily decomposed by a heat treatment (calcination) or light irradiation to be described later or a block copolymer which is easily removed with a solvent.

The hard magnetic material precursor and the soft magnetic material precursor used in the present invention are not particularly limited, as long as these are inorganic precursors capable of forming the above-described hard magnetic material and soft magnetic material, respectively, by the conversion treatment to be described later. Specifically, preferred are salts of a metal or metalloid constituting the hard magnetic material and the soft magnetic material (for example, carbonates, nitrates, phosphates, sulfates, acetates, chlorides, organic acid salts (such as acrylates)), alkoxides having 1 to 4 carbon atoms and containing the metal or the metalloid (for example, methoxides, ethoxides, propoxides, and butoxides), complexes of the metal or the metalloid (for example, acetylacetonate complexes), and organometallic compounds or organometalloidal compounds containing the metal or the metalloid (for example, those having at least one structure selected from the group consisting of a phenyl group, long hydrocarbon chains having 5 or more carbon atoms, a cyclooctatetraene ring, a cyclopentadienyl ring, and an amino group). One kind or two or more kinds of such hard magnetic material precursors and one kind or two or more kinds of such soft magnetic material precursors are selected as appropriate for use, in accordance with the combination of the hard magnetic material and the soft magnetic material constituting the desired nanoheterostructured permanent magnet, so that the precursors satisfy the above-described various conditions.

The solvent used in the present invention is not particularly limited, as long as the solvent is capable of dissolving the block copolymer and the first and second inorganic precursors to be used. Examples of the solvent include acetone, tetrahydrofuran (THF), toluene, propylene glycol monomethyl ether acetate (PGMEA), propylene glycol monomethyl ether (PGME), chloroform, benzene, and the like. One of these solvents may be used alone, or two or more thereof may be used as a mixture.

Note that, in the present description, "to dissolve" means a phenomenon that a substance (solute) is dissolved in a solvent to form a homogeneous mixture (solution), and includes cases where after dissolving, at least part of the solute becomes ions, where the solute is not dissociated into ions, but exists as molecules, and where the solute exists as associated molecules or ions, and other cases.

In the present invention, the first polymer block component is used in combination with the first inorganic precursor, which is one of the hard magnetic material precursor and the soft magnetic material precursor, and the second polymer block component is used in combination with the second inorganic precursor, which is the other of the precursors. Moreover, it is preferable to use a first inorganic precursor having a solubility parameter different from that of the first polymer block component by 2 $(cal/cm^3)^{1/2}$ or less in combination with a second inorganic precursor having a solubility parameter different from that of the second polymer block component by 2 $(cal/cm^3)^{1/2}$ or less. By using the first inorganic precursor and the second inorganic precursor satisfying such conditions in combination, in the step of forming the nanophase-separated structure described later, a nanophase-separated structure is formed with achievement of self-assembly of the block copolymer, while the first inorganic precursor and the second inorganic precursor are sufficiently introduced into the first polymer block component and the second polymer block component, respectively. Thereby, the inorganic precursors are arranged with a three-dimensional nanoscale periodicity.

A solubility parameter difference between the first polymer block component and the first inorganic precursor used in the present invention is preferably smaller than a solubility parameter difference between the first polymer block component and the second inorganic precursor. Meanwhile, a solubility parameter difference between the second polymer block component and the second inorganic precursor is preferably smaller than a solubility parameter difference between the second polymer block component and the first inorganic precursor. Moreover, it is more preferable to satisfy both the conditions.

Moreover, the first inorganic precursor used in the present invention preferably has a solubility parameter different from that of the second polymer block component by more than 2 $(cal/cm^3)^{1/2}$. Meanwhile, the second inorganic precursor preferably has a solubility parameter different from that of the first polymer block component by more than 2 $(cal/cm^3)^{1/2}$. Furthermore, it is more preferable to satisfy both the conditions.

By using the first inorganic precursor and the second inorganic precursor satisfying such conditions in combination, a part of the second inorganic precursor and a part of the first inorganic precursor tend to be more surely prevented from being introduced as impurities into the first polymer block component and the second polymer block component, respectively, in the step of forming the nanophase-separated structure described later. Moreover, the purity of the inorganic component constituting the matrix and/or the purity of the inorganic component arranged in the matrix in a nanoheterostructured permanent magnet to be obtained tend to be more improved.

Preferred combinations of the first and second polymer block components and the first and second inorganic precursors satisfying such conditions are those in which the first polymer block component is at least one low-polarity polymer block component selected from the group consisting of a polystyrene component, a polyisoprene component, and a polybutadiene component, the second polymer block component is at least one high-polarity polymer block component selected from the group consisting of a poly(methyl methacrylate) component, a poly(ethylene oxide) component, a polyvinylpyridine component, and a poly(acrylic acid) component, the first inorganic precursor is at least one low-polarity inorganic precursor selected from the group consisting of the above-described organometallic compounds and the above-described organometalloidal compounds, and the second inorganic precursor is at least one high-polarity inorganic precursor selected from the group consisting of the above-described salts of metals or metalloids, the above-described metal- or metalloid-containing alkoxides having 1 to 4 carbon atoms, and the above-described of metal or metalloid acetylacetonate complexes.

In addition, preferably, at least one (more preferably both) of the first inorganic precursor and the second inorganic precursor has a solubility parameter different from that of the solvent used by 2 $(cal/cm^3)^{1/2}$ or less. By using the first inorganic precursor and/or the second inorganic precursor satisfying such a condition, the inorganic precursor tends to be more surely dissolved in the solvent, and the inorganic precursor tends to be more surely introduced into the polymer block component in the step of forming the nanophase-separated structure described later.

Moreover, the ratios of the solutes (the block copolymer, the first inorganic precursor, and the second inorganic precursor) in the obtained raw material solution are not particularly limited. When a total amount of the raw material solution is taken as 100% by mass, the total amount of the solutes is preferably around 0.1 to 30% by mass and more preferably 0.5 to 10% by mass. Further, by adjusting the amounts of the first and second inorganic precursors used relative to the block copolymer, the amount of each inorganic precursor introduced into the corresponding polymer block component is adjusted, so that the volume of the predetermined part of the soft magnetic material in the obtained nanoheterostructured permanent magnet can be controlled to a desired ratio. For example, by increasing the amount of the inorganic precursor introduced into the polymer block component constituting the polymer phase into which the soft magnetic material precursor is introduced, the ratio of the volume of the predetermined part of the soft magnetic material can be increased.

Second Step: Nanoheterostructured Permanent Magnet Formation Step

This step is a step including a phase-separation treatment, a conversion treatment, and a removal treatment, which are to be described in detail below, to thereby prepare a nanoheterostructured permanent magnet comprising a hard magnetic material and a soft magnetic material.

First, the raw material solution prepared in the first step contains the block copolymer, the hard magnetic material precursor, and the soft magnetic material precursor. In the present invention, it is preferable to use the first polymer block component in combination with the first inorganic precursor which is one of the hard magnetic material precursor and the soft magnetic material precursor, and to use the second polymer block component in combination with the second inorganic precursor which is the other of the precursors. Moreover, it is further preferable to use a first inorganic precursor having a solubility parameter different from that of the first polymer block component by 2 $(cal/cm^3)^{1/2}$ or less in combination with a second inorganic precursor having a solubility parameter different from that of the second polymer block component by 2 $(cal/cm^3)^{1/2}$ or less. Accordingly, the first inorganic precursor and the second inorganic precursor exist in such a state that the first inorganic precursor and the second inorganic precursor are sufficiently introduced into the first polymer block component and the second polymer block component, respectively. Hence, by the phase-separation treatment for forming a nanophase-separated structure by self-assembly of the block copolymer, a first polymer phase comprising the first polymer block component with the first inorganic precursor introduced thereinto and a second polymer phase comprising the second polymer block component with the second inorganic precursor introduced thereinto are regularly arranged, and the inorganic precursors are arranged with a three-dimensional nanoscale periodicity.

Such a phase-separation treatment is not particularly limited. By carrying out a heat treatment at or above a glass transition temperature of the block copolymer used, self-assembly of the block copolymer is achieved, and the phase-separated structure is obtained.

Next, in the present invention, the nanophase-separated structure formed by the phase-separation treatment is subjected to the conversion treatment for converting the hard magnetic material precursor and the soft magnetic material precursor to a hard magnetic material and a soft magnetic material, respectively; and the removal treatment for removing the block copolymer from the nanophase-separated structure. The hard magnetic material precursor and the soft magnetic material precursor are converted to the hard magnetic material and the soft magnetic material, respectively, by such a conversion treatment, and the block copolymer is removed by such a removal treatment. Thereby, a nanoheterostructured permanent magnet of the present invention is obtained which comprises a hard magnetic material and a soft magnetic material of which one inorganic component is a matrix, and of which the other inorganic component is arranged with a three-dimensional specific nanoscale periodicity in the matrix in such a shape as a spherical shape, a columnar shape, a gyroid shape, or a lamellar structure, in accordance with the type (shape) of the nanophase-separated structure.

Such a conversion treatment may be a step of heating at or above a temperature at which the inorganic precursors are converted to the inorganic components for conversion to the inorganic components, or a step of subjecting the inorganic precursors to hydrolysis and dehydration condensation for conversion to the inorganic components.

Meanwhile, the removal treatment may be a step of decomposing the block copolymer by a heat treatment (calcination) at or above a temperature at which the block copolymer is decomposed, a step of removing the block copolymer by dissolving the block copolymer in a solvent, or a step of decomposing the block copolymer by light irradiation such as ultraviolet ray irradiation.

Further, in the second step of the present invention, if the raw material solution prepared in the first step is subjected to a heat treatment (calcination) at or above a temperature at which the block copolymer is decomposed, the phase-separation treatment, the conversion treatment, and the removal treatment can be conducted at once in a single heat treatment. In order to complete the phase-separation treatment, the conversion treatment, and the removal treatment by only one heat treatment in this manner, the heat treatment is carried out preferably at 300 to 1200° C. (more preferably 400 to 900° C.) for approximately 0.1 to 50 hours, although the conditions vary depending on the kinds of the block copolymer and the inorganic precursors to be used.

Such a heat treatment may be carried out in an inert gas atmosphere (for example, nitrogen gas or the like), an oxidizing gas atmosphere (for example, air or the like), or a reducing gas atmosphere (for example, hydrogen or the like). When the inorganic precursors are converted to the inorganic components and the block copolymer is removed in an inert gas atmosphere, the three-dimensional nanoscale periodic structure tends to be kept more surely. Meanwhile, when the inorganic precursors are converted to the inorganic components in an oxidizing gas atmosphere, a permanent magnet including a hard magnetic material and a soft magnetic material each comprising an oxide of a metal or a metalloid can be obtained. Further, when the inorganic precursors are converted to the inorganic components in a reducing gas atmosphere, a permanent magnet including a hard magnetic material and a soft magnetic material each comprising a metal or a metalloid can be obtained. The conditions of such a heat treatment in an inert gas atmosphere, an oxidizing gas atmosphere, or a reducing gas atmosphere are not particularly limited. The treatment is preferably carried out at 300 to 1200° C. (more preferably 400 to 900° C.) for approximately 0.1 to 50 hours.

After the first step, the second step may be performed on the raw material solution introduced into a heat treatment container, or the second step may be performed after the raw material solution is applied onto a surface of a substrate, in the method for producing a nanoheterostructured permanent magnet of the present invention. By the latter method, a film-shaped nanoheterostructured permanent magnet can be formed directly on the surface of the substrate. The kind of the substrate used is not particularly limited, but may be selected as appropriate depending on the application of the nanoheterostructured permanent magnet to be obtained. Moreover, brush painting, a spray method, a dipping method, a spin method, a curtain flow method, or the like is used as a method for applying the raw material solution.

EXAMPLES

Hereinafter, the present invention will be described more specifically on the basis of Examples and Comparative Examples. However, the present invention is not limited to Examples below.

Example 1

A raw material solution was obtained by dissolving, in 10 mL of toluene, 0.1 g of a polystyrene-b-poly(4-vinylpyridine) (PS-b-P4VP, the number average molecular weight of the PS component: $50\times10^3$, the number average molecular weight of the P4VP component: $13\times10^3$) as a block copolymer, 0.039 g of iron(III) chloride ($FeCl_3$) and 0.123 g of chloroplatinic(IV) acid ($H_2[PtCl_6]$) as an FePt precursor (an Fe precursor and a Pt precursor), which was a hard magnetic material precursor, and 0.174 g of iron(III) diphenylpropanedionate ($Fe(OC(Ph)=CHC(=O)Ph)_3$) as an Fe precursor, which was a soft magnetic material precursor.

Next, the obtained raw material solution was placed in a heat treatment container, and subjected to a heat treatment in argon at 700° C. for 6 hours. Thus, an inorganic structure (0.8 cm×0.8 cm×2 μm) was obtained.

Figure 2:
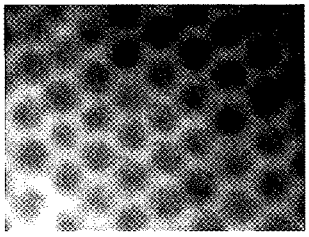
FIG. 2 is a transmission electron microphotograph of a nanoheterostructured permanent magnet obtained in Example 1.

The obtained inorganic structure was observed with a transmission electron microscope (TEM). As shown in FIG. 2, a nanoheterostructure was confirmed in which FePt (platinum-iron alloy), which was a hard magnetic material, was three-dimensionally and periodically arranged in a spherical shape in an Fe (iron) matrix, which was a soft magnetic material. In addition, the volume of part of the region comprising the soft magnetic material (Fe), the part satisfying the condition that the distance from the interface with the hard magnetic material (FePt) was 10 nm or less, accounted for 91% by volume of the total volume of the soft magnetic material (Fe).

Further, a small-angle X-ray diffraction pattern of the obtained inorganic structure was measured with a small-angle X-ray diffractometer (manufactured by Rigaku Corporation, product name: NANO-Viewer). The distance (d) of the periodic structure was 16.1 nm, and a diffraction peak pattern characteristic of a spherical structure (i.e., the ratio of magnitudes (q) of the diffraction spectra at peak positions) was confirmed.

Moreover, a magnetization curve of the obtained inorganic structure was measured with a vibrating sample magnetometer (manufactured by TOEI INDUSTRY CO., LTD., product name: VSM-3S-15) in the range up to 20 kOe at room temperature, and the maximum energy product was determined. The maximum energy product was higher than that of an FePt single-phase permanent magnet by 25%.

Example 2

An inorganic structure (0.8 cm×0.8 cm×2 μm) was fabricated in the same manner as in Example 1, except that 0.1 g of a PS-b-P4VP whose PS component had a number average molecular weight of $40\times10^3$ and whose P4VP component had a number average molecular weight of $18\times10^3$ was used as a block copolymer, and that 0.039 g of iron(III) chloride ($FeCl_3$) and 0.073 g of palladium acetylacetonate ($Pd(acac)_2$), which was an FePd precursor (an Fe precursor and a Pd precursor), were used as a hard magnetic material precursor.

Figure 3:
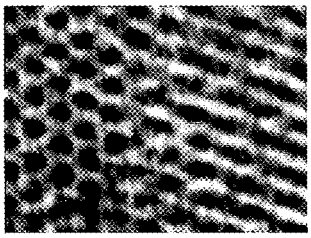
FIG. 3 is a transmission electron microphotograph of a nanoheterostructured permanent magnet obtained in Example 2.

The obtained inorganic structure was observed with a transmission electron microscope (TEM) in the same manner as in Example 1. As shown in FIG. 3, a nanoheterostructure was confirmed in which FePd (palladium-iron alloy), which was a hard magnetic material, was three-dimensionally and periodically arranged in a columnar shape in an Fe (iron) matrix, which was a soft magnetic material. In addition, the volume of part of the region comprising the soft magnetic material (Fe), the part satisfying the condition that the distance from the interface with the hard magnetic material (FePd) was 10 nm or less, accounted for 88% by volume of the total volume of the soft magnetic material (Fe).

In addition, a small-angle X-ray diffraction pattern of the obtained inorganic structure was measured in the same manner as in Example 1. The distance (d) of the periodic structure was 18.9 nm, and a diffraction peak pattern characteristics of a columnar structure (the ratio of magnitudes (q) of the diffraction spectra at the peak positions) was confirmed.

Moreover, the maximum energy product of the obtained inorganic structure was determined in the same manner as in Example 1. The maximum energy product was higher than that of a FePd single-phase permanent magnet by 19%.

Example 3

A raw material solution was obtained by dissolving, in 10 mL of tetrahydrofuran (THF, solubility parameter: 9.1 $(cal/cm^3)^{1/2}$), 0.1 g of a polystyrene-b-poly(4-vinylpyridine) (PS-b-P4VP, the number average molecular weight of the PS component: $13\times10^3$, the solubility parameter of the PS component: 9.1 $(cal/cm^3)^{1/2}$, the number average molecular weight of the P4VP component: $50\times10^3$, and the solubility parameter of the P4VP component: 12.0 $(cal/cm^3)^{1/2}$) as a block copolymer, 0.042 g of neodymium acetylacetonate ($Nd(acac)_3$, solubility parameter: 9.0 $(cal/cm^3)^{1/2}$) and 0.214 g of iron acetylacetonate ($Fe(acac)_3$, solubility parameter: 9.0 $(cal/cm^3)^{1/2}$) as an $Nd_2Fe_{14}B$ precursor (an Nd precursor and an Fe precursor), which was a hard magnetic material precursor, and 0.154 g of iron pyrrolidinedithiocarbamate (FePDC, solubility parameter: 11.4 $(cal/cm^3)^{1/2}$) as an Fe precursor, which was a soft magnetic material precursor.

Next, the obtained raw material solution was placed in a heat treatment container together with 0.024 g of boric acid and 1.54 g of calcium hydride, and subjected to a heat treatment under vacuum at 700° C. for 6 hours, followed by washing with acetic acid and acetone. Thus, an inorganic structure (0.8 cm×0.8 cm×2 μm) was obtained.

The obtained inorganic structure was observed with a transmission electron microscope (TEM) in the same manner as in Example 1. A nanoheterostructure was confirmed in which Fe (iron), which was the soft magnetic material, was three-dimensionally and periodically arranged in a spherical shape in an $Nd_2Fe_{14}B$ matrix, which was the hard magnetic material. In addition, the volume of part of the region comprising the soft magnetic material (Fe), the part satisfying the condition that the distance from the interface with the hard magnetic material ($Nd_2Fe_{14}B$) was 10 nm or less, accounted for 94% by volume of the total volume of the soft magnetic material (Fe).

In addition, a small-angle X-ray diffraction pattern of the obtained inorganic structure was measured in the same manner as in Example 1. The distance (d) of the periodic structure was 18.2 nm, and a diffraction peak pattern characteristic of a spherical structure (the ratio of magnitudes (q) of the diffraction spectra at the peak positions) was confirmed.

Moreover, the maximum energy product of the obtained inorganic structure was determined in the same manner as in Example 1. The maximum energy product was higher than that of an $Nd_2Fe_{14}B$ single-phase permanent magnet by 14%.

Example 4

A raw material solution was obtained by dissolving, in 10 mL of tetrahydrofuran (THF, solubility parameter: 9.1 $(cal/cm^3)^{1/2}$), 0.1 g of a polystyrene-b-poly(4-vinylpyridine) (PS-b-P4VP, the number average molecular weight of the PS component: $18\times10^3$, the solubility parameter of the PS component: 9.1 $(cal/cm^3)^{1/2}$, the number average molecular weight of the P4VP component: $40\times10^3$, the solubility parameter of the P4VP component: 12.0 $(cal/cm^3)^{1/2}$) as a block copolymer, 0.042 g of samarium acetylacetonate ($Sm(acac)_3$, solubility parameter: 9.0 $(cal/cm^3)^{1/2}$) and 0.084 g of cobalt acetylacetonate ($Co(acac)_3$, solubility parameter: 8.8 $(cal/cm^3)^{1/2}$) as an $SmCo_5$ precursor (an Sm precursor and a Co precursor), which was a hard magnetic material precursor, and 0.154 g of iron pyrrolidinedithiocarbamate (FePDC, solubility parameter: 11.4 $(cal/cm^3)^{1/2}$) as an Fe precursor, which was a soft magnetic material precursor.

Next, the obtained raw material solution was placed in a heat treatment container together with 1.40 g of calcium hydride, and subjected to a heat treatment under vacuum at 700° C. for 6 hours, followed by washing with acetic acid and acetone. Thus, an inorganic structure (0.8 cm×0.8 cm×2 μm) was obtained.

The obtained inorganic structure was observed with a transmission electron microscope (TEM) in the same manner as in Example 1. A nanoheterostructure was confirmed in which Fe (iron), which was a soft magnetic material, was three-dimensionally and periodically arranged in a columnar shape in an $SmCo_5$ matrix, which was a hard magnetic material. In addition, the volume of part of the region comprising the soft magnetic material (Fe), the part satisfying the condition that the distance from the interface with the hard magnetic material ($SmCo_5$) was 10 nm or less, accounted for 92% by volume of the total volume of the soft magnetic material (Fe).

In addition, a small-angle X-ray diffraction pattern of the obtained inorganic structure was measured in the same manner as in Example 1. The distance (d) of the periodic structure was 17.9 nm, and a diffraction peak pattern characteristics of a columnar structure (the ratio of magnitudes (q) of the diffraction spectra at the peak positions) was confirmed.

Moreover, the maximum energy product of the obtained inorganic structure was determined in the same manner as in Example 1. The maximum energy product was higher than that of an $SmCo_5$ single-phase permanent magnet by 11%.

Example 5

An inorganic structure (0.8 cm×0.8 cm×2 μm) was fabricated in the same manner as in Example 1, except that 0.066 g of iron acetylacetonate ($Fe(acac)_3$, solubility parameter: 9.0 $(cal/cm^3)^{1/2}$) and 0.064 g of platinum acetylacetonate ($Pt(acac)_2$, solubility parameter: 9.0 $(cal/cm^3)^{1/2}$) which were an FePt precursor (an Fe precursor and a Pt precursor), were used as a hard magnetic material precursor, 0.141 g of iron pyrrolidinedithiocarbamate (FePDC, solubility parameter: 11.4 $(cal/cm^3)^{1/2}$), which was an Fe precursor, was used as a soft magnetic material precursor, and 10 mL of tetrahydrofuran (THF, solubility parameter: 9.1 $(cal/cm^3)^{1/2}$) was used instead of toluene. Note that the PS component of the block copolymer, PS-b-P4VP, had a solubility parameter of 9.1 $(cal/cm^3)^{1/2}$, and the P4VP component thereof had a solubility parameter of 12.0 $(cal/cm^3)^{1/2}$.

The obtained inorganic structure was observed with a transmission electron microscope (TEM) in the same manner as in Example 1. A nanoheterostructure was confirmed in which FePt (platinum-iron alloy), which was a hard magnetic material, was three-dimensionally and periodically arranged in a spherical shape in an Fe (iron) matrix, which was a soft magnetic material. In addition, the volume of part of the region comprising the soft magnetic material (Fe), the part satisfying the condition that the distance from the interface with the hard magnetic material (FePt) was 10 nm or less, accounted for 94% by volume of the total volume of the soft magnetic material (Fe).

In addition, a small-angle X-ray diffraction pattern of the obtained inorganic structure was measured in the same manner as in Example 1. The distance (d) of the periodic structure was 17.3 nm, and a diffraction peak pattern characteristic of a spherical structure (the ratio of magnitudes (q) of the diffraction spectra at the peak positions) was confirmed.

Moreover, the maximum energy product of the obtained inorganic structure was determined in the same manner as in Example 1. The maximum energy product was higher than that of an FePt single-phase permanent magnet by 28%.

INDUSTRIAL APPLICABILITY

As described above, the present invention makes it possible to obtain a permanent magnet having a nanoheterostructure comprising a hard magnetic material and a soft magnetic material of which one inorganic component is a matrix, and of which the other inorganic component is three-dimensionally and periodically arranged in a predetermined shape on a predetermined nanoscale in the matrix.

The nanoheterostructured permanent magnet of the present invention has a structure that has not been formed by conventional production methods. It is possible to obtain nanoheterostructures in which the arrangement, composition, structure scale, and the like of various combinations of the hard magnetic material and the soft magnetic material are controlled in various ways.

The permanent magnet having such a nanoheterostructure exhibits a flux pinning effect because of the magnetic exchange interaction between the hard magnetic material and the soft magnetic material, and achieves remarkable improvements in interface increasing effect, nanosize effect, durability, and the like upon conventional nanostructured permanent magnets. Consequently, the permanent magnet has both the high coercive force of the hard magnetic material and the high saturation magnetization of the soft magnetic material. Hence, the nanoheterostructured permanent magnet of the present invention is useful as a permanent magnet for motors, power generators, coils for various sensors, cap magnets, and the like.

What is claimed is:

1. A method for producing a nanoheterostructured permanent magnet, comprising:

a first step of preparing a raw material solution by dissolving, in a solvent, a block copolymer comprising at least a first polymer block component and a second polymer block component which are immiscible but linked to each other, a first inorganic precursor which is one of a hard magnetic material precursor and a soft magnetic material precursor, and a second inorganic precursor which is the other of the hard magnetic material precursor and the soft magnetic material precursor; and a second step including a phase-separation treatment for forming a nanophase-separated structure in which at least a first polymer phase comprising the first polymer block component with the first inorganic precursor introduced thereinto and a second polymer phase comprising the second polymer block component with the second inorganic precursor introduced thereinto are regularly arranged by self-assembly, a conversion treatment for converting the hard magnetic material precursor and the soft magnetic material precursor to a hard magnetic material and a soft magnetic material, respectively, and a removal treatment for removing the block copolymer from the nanophase-separated structure, to thereby obtain a nanoheterostructured permanent magnet comprising the hard magnetic material and the soft magnetic material.

2. The method for producing a nanoheterostructured permanent magnet according to claim 1, wherein a solubility parameter difference between the first inorganic precursor and the first polymer block component is 2 $(cal/cm^3)^{1/2}$ or less, and a solubility parameter difference between the second inorganic precursor and the second polymer block component is 2 $(cal/cm^3)^{1/2}$ or less.

3. The method for producing a nanoheterostructured permanent magnet according to claim 2, wherein a solubility parameter difference between the first polymer block component and the first inorganic precursor is smaller than a solubility parameter difference between the first polymer block component and the second inorganic precursor.

4. The method for producing a nanoheterostructured permanent magnet according to claim 2, wherein a solubility parameter difference between the second polymer block component and the second inorganic precursor is smaller than a solubility parameter difference between the second polymer block component and the first inorganic precursor.

5. The method for producing a nanoheterostructured permanent magnet according to claim 2, wherein the block copolymer comprises at least one first polymer block component and at least one second polymer block component which are linked to each other, the first polymer block component being selected from the group consisting of a polystyrene component, a polyisoprene component, and a polybutadiene component, the second polymer block component being selected from the group consisting of a poly(methyl methacrylate) component, a poly(ethylene oxide) component, a polyvinylpyridine component, and a poly(acrylic acid) component, the first inorganic precursor is at least one of organometallic compounds and organometalloidal compounds having at least one structure selected from the group consisting of a phenyl group, long hydrocarbon chains having 5 or more carbon atoms, a cyclooctatetraene ring, a cyclopentadienyl ring, and an amino group, and the second inorganic precursor is at least one selected from the group consisting of salts of metals or metalloids, metal- or metalloid-containing alkoxides having 1 to 4 carbon atoms, and metal or metalloid acetylacetonate complexes.

6. The method for producing a nanoheterostructured permanent magnet according claim 2, wherein a molecular weight of a polymer block component constituting a polymer phase into which the soft magnetic material precursor is introduced and a molecular weight ratio between the polymer block component constituting the polymer phase into which the soft magnetic material precursor is introduced and a polymer block component constituting a polymer phase into which the hard magnetic material precursor is introduced are adjusted such that a volume of part of a region comprising the soft magnetic material is controlled to 50% by volume or more of a total volume of the soft magnetic material, the part satisfying a condition that a distance from an interface with the hard magnetic material is 10 nm or less.

7. The method for producing a nanoheterostructured permanent magnet according to claim 1, wherein a solubility parameter difference between the first polymer block component and the first inorganic precursor is smaller than a solubility parameter difference between the first polymer block component and the second inorganic precursor.

8. The method for producing a nanoheterostructured permanent magnet according to claim 1, wherein a solubility parameter difference between the second polymer block component and the second inorganic precursor is smaller than a solubility parameter difference between the second polymer block component and the first inorganic precursor.

9. The method for producing a nanoheterostructured permanent magnet according to claim 1, wherein the block copolymer comprises at least one first polymer block component and at least one second polymer block component which are linked to each other, the first polymer block component being selected from the group consisting of a polystyrene component, a polyisoprene component, and a polybutadiene component, the second polymer block component being selected from the group consisting of a poly(methyl methacrylate) component, a poly(ethylene oxide) component, a polyvinylpyridine component, and a poly(acrylic acid) component, the first inorganic precursor is at least one of organometallic compounds and organometalloidal compounds having at least one structure selected from the group consisting of a phenyl group, long hydrocarbon chains having 5 or more carbon atoms, a cyclooctatetraene ring, a cyclopentadienyl ring, and an amino group, and the second inorganic precursor is at least one selected from the group consisting of salts of metals or metalloids, metal- or metalloid-containing alkoxides having 1 to 4 carbon atoms, and metal or metalloid acetylacetonate complexes.

10. The method for producing a nanoheterostructured permanent magnet according claim 1, wherein a molecular weight of a polymer block component constituting a polymer phase into which the soft magnetic material precursor is introduced and a molecular weight ratio between the polymer block component constituting the polymer phase into which the soft magnetic material precursor is introduced and a polymer block component constituting a polymer phase into which the hard magnetic material precursor is introduced are adjusted such that a volume of part of a region comprising the soft magnetic material is controlled to 50% by volume or more of a total volume of the soft magnetic material, the part satisfying a condition that a distance from an interface with the hard magnetic material is 10 nm or less.

* * * * *